US009303934B1

(12) United States Patent
Kazsuk

(10) Patent No.: US 9,303,934 B1
(45) Date of Patent: Apr. 5, 2016

(54) AMMUNITION LOADING ASSEMBLY

(71) Applicant: Daniel Kazsuk, Arlington, TX (US)

(72) Inventor: Daniel Kazsuk, Arlington, TX (US)

( * ) Notice: Subject to any disclaimer, the term of this patent is extended or adjusted under 35 U.S.C. 154(b) by 0 days.

(21) Appl. No.: 14/669,244

(22) Filed: Mar. 26, 2015

(51) Int. Cl.
*F41A 9/83* (2006.01)
*F41A 9/64* (2006.01)

(52) U.S. Cl.
CPC .... *F41A 9/83* (2013.01); *F41A 9/64* (2013.01)

(58) Field of Classification Search
CPC ..... F41A 9/67; F41A 9/71; F41A 9/61; F41A 9/62; F41A 9/64; F41A 9/65; F41A 9/83; F41A 9/82; F41A 9/86
USPC ..... 42/50
See application file for complete search history.

(56) References Cited

U.S. PATENT DOCUMENTS 1,245,499 A * 11/1917 Orme ..... F41A 9/67 124/52
1,500,580 A * 7/1924 Fererro ..... F41A 9/67 42/50
1,797,951 A * 3/1931 Gaidos ..... F41A 9/67 42/50
2,296,729 A * 9/1942 Mossberg ..... F41A 9/71 42/49.02
2,569,995 A * 10/1951 Kapsa ..... F41A 9/62 116/298
3,736,686 A * 6/1973 Moller ..... F41A 9/83 42/50
4,430,821 A 2/1984 Vincent
4,688,344 A * 8/1987 Kim ..... F41A 9/67 42/50
4,831,761 A * 5/1989 Kulakow ..... F41A 9/67 42/50
5,291,679 A * 3/1994 Wollack ..... F41A 9/67 42/50
5,309,660 A 5/1994 Blackamore
6,219,953 B1 4/2001 Bentley
7,200,964 B2 4/2007 Gates
7,497,044 B2 3/2009 Cammenga et al.
D604,792 S 11/2009 Stanley
8,069,601 B1 * 12/2011 Fitzpatrick ..... F41A 9/62 42/50
8,234,810 B2 8/2012 Lee, III
8,468,730 B2 * 6/2013 Faifer ..... F41A 9/67 42/50
8,713,835 B1 * 5/2014 Calvert ..... F41A 9/71 42/49.01
9,010,005 B2 * 4/2015 Faifer ..... F41A 9/65 42/49.01
9,103,614 B2 * 8/2015 Froehle ..... F41A 9/67
2005/0150148 A1 7/2005 Herpel
2005/0188579 A1 * 9/2005 Gates ..... F41A 9/71 42/50
2011/0005115 A1 * 1/2011 Cahill ..... F41A 17/34 42/49.01
2011/0030259 A1 * 2/2011 Castro ..... F41A 9/67 42/6
2012/0030987 A1 * 2/2012 Lee, III ..... F41A 9/67 42/87
2015/0075052 A1 * 3/2015 Boyarkin ..... F41A 9/67 42/87

FOREIGN PATENT DOCUMENTS

WO WO2013154455 10/2013

* cited by examiner

*Primary Examiner* — Joshua Freeman

(57) ABSTRACT

An ammunition loading assembly includes a magazine that has a top end and the magazine may insertably receive ammunition. A biasing member is positioned within the magazine and the biasing member urges the ammunition upwardly toward the top end. A loading unit is positioned within the magazine. The loading unit compresses the biasing member to facilitate the ammunition to be loaded into the magazine.

12 Claims, 3 Drawing Sheets

AMMUNITION LOADING ASSEMBLY

BACKGROUND OF THE DISCLOSURE

Field of the Disclosure

The disclosure relates to loading devices and more particularly pertains to a new loading device for loading ammunition into a magazine.

SUMMARY OF THE DISCLOSURE

An embodiment of the disclosure meets the needs presented above by generally comprising a magazine that has a top end and the magazine may insertably receive ammunition. A biasing member is positioned within the magazine and the biasing member urges the ammunition upwardly toward the top end. A loading unit is positioned within the magazine. The loading unit compresses the biasing member to facilitate the ammunition to be loaded into the magazine.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
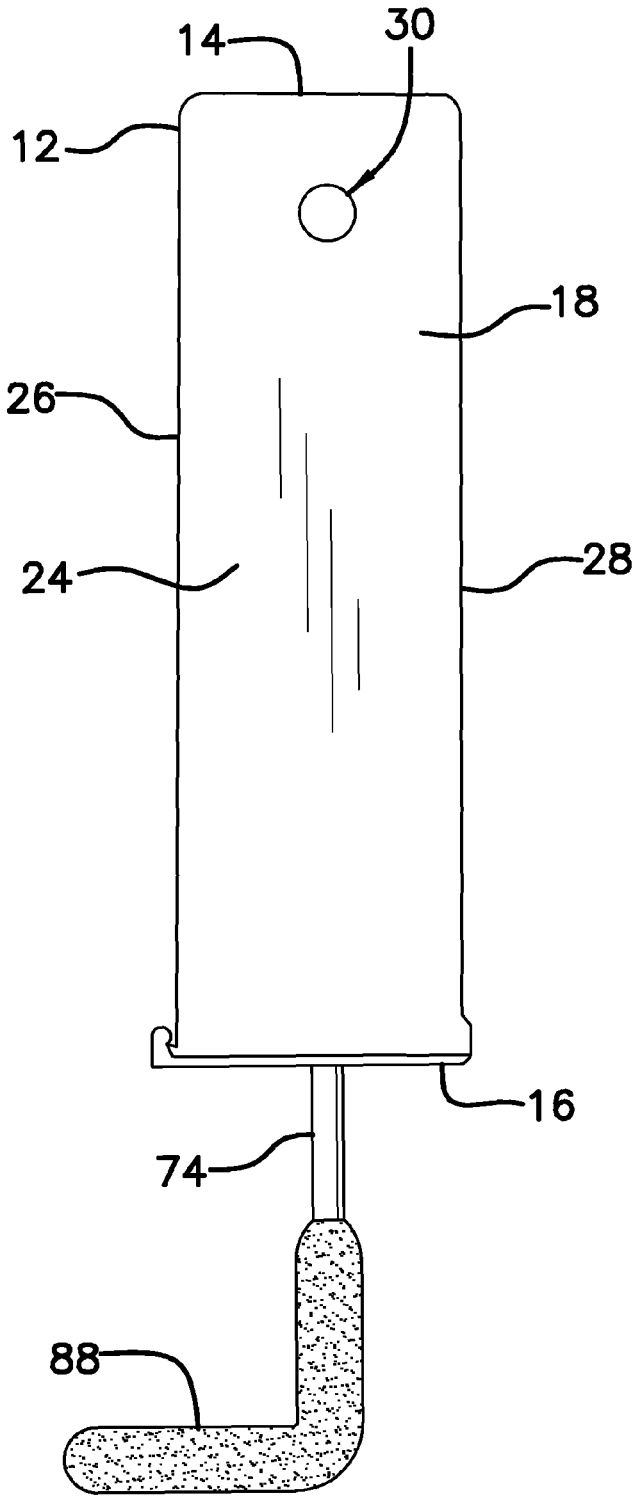
FIG. 1 is a left side view of an ammunition loading assembly according to an embodiment of the disclosure.
Figure 2:
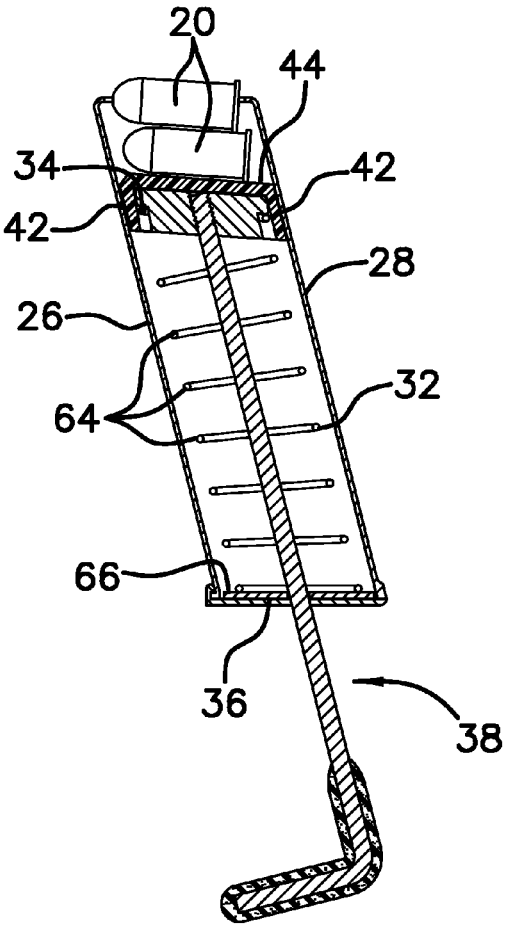
FIG. 2 is a cross sectional view taken along line 2-2 of FIG. 1 of an embodiment of the disclosure.
Figure 3:
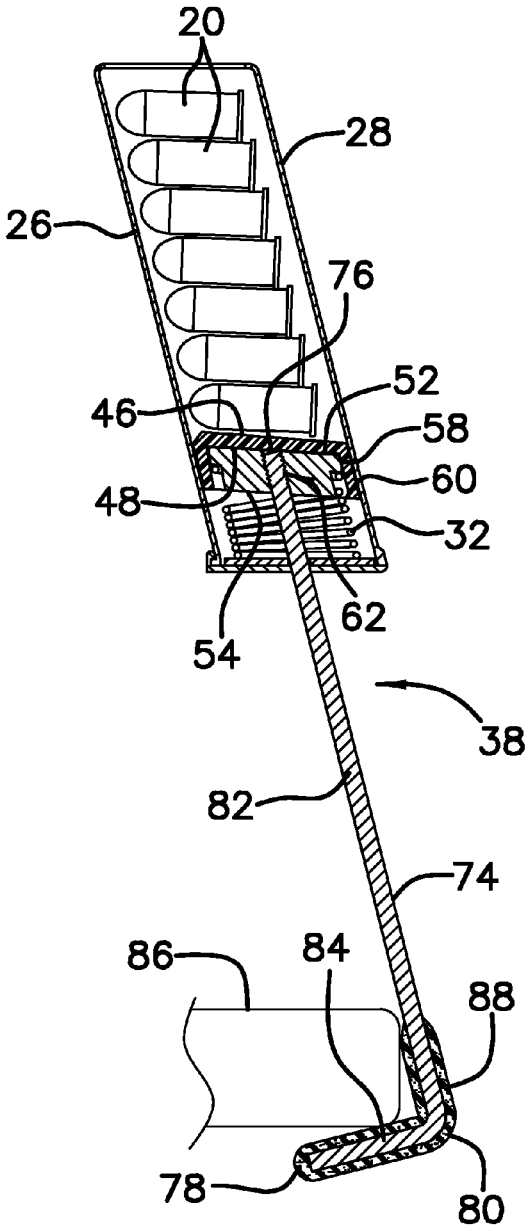
FIG. 3 is a cross sectional view taken along line 2-2 of FIG. 1 of an embodiment of the disclosure in a compressed configuration.
Figure 4:
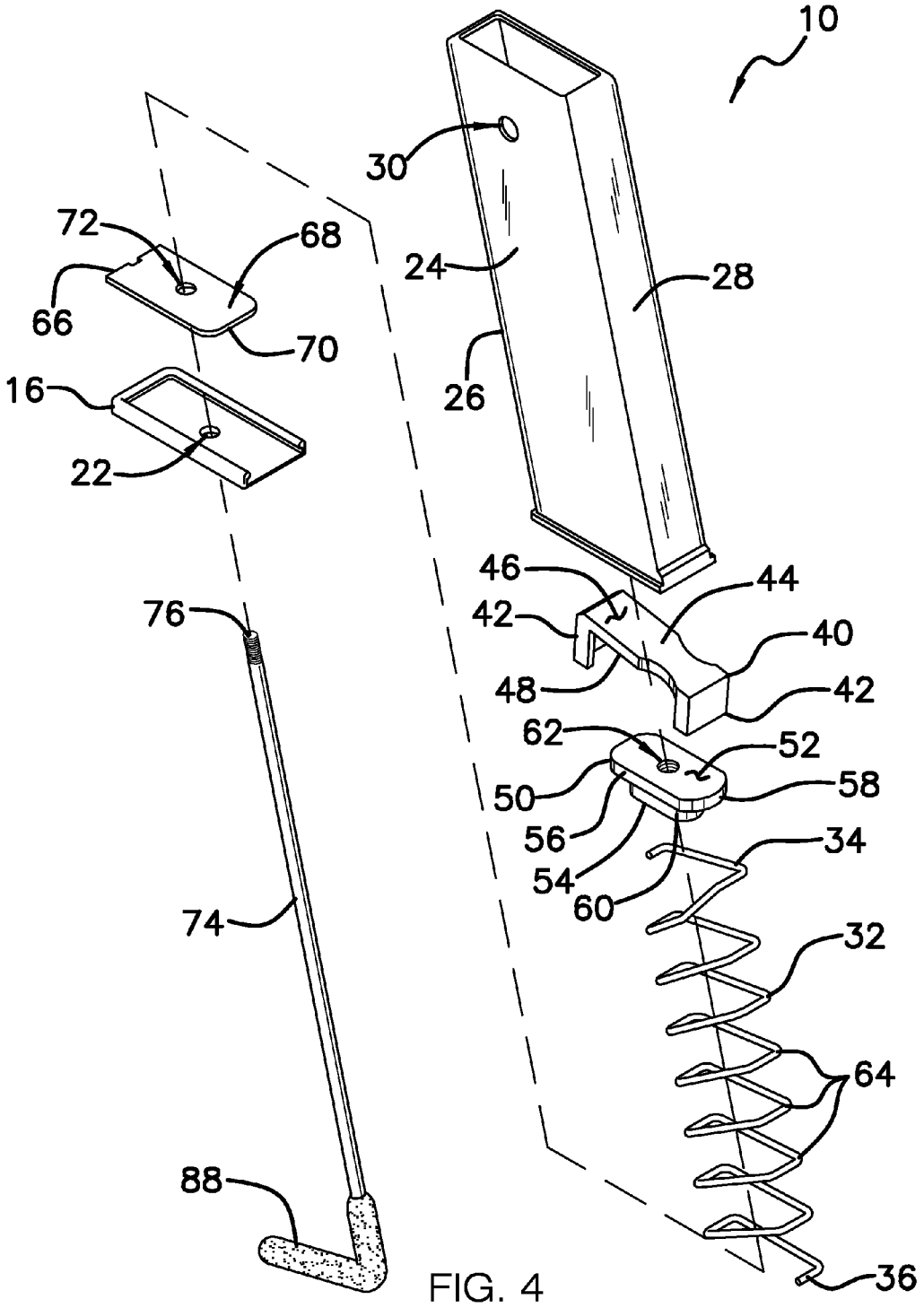
FIG. 4 is an exploded perspective view of an embodiment of the disclosure.

With reference now to the drawings, and in particular to FIGS. 1 through 4 thereof, a new loading device embodying the principles and concepts of an embodiment of the disclosure and generally designated by the reference numeral 10 will be described.

As best illustrated in FIGS. 1 through 4, the ammunition loading assembly 10 generally comprises a magazine 12 that has a top end 14, a bottom end 16 and a peripheral wall 18 extending between the top end 14 and the bottom end 16. The top end 14 is open and the magazine 12 is substantially hollow. The top end 14 may insertably receive ammunition 20 and the bottom end 16 has an aperture 22 extending therethrough. The aperture 22 is centrally positioned on the bottom end 16. The peripheral wall 18 has a first lateral side 24, a front side 26 and a back side 28. The first lateral side 24 has an opening 30 extending therethrough and the opening 30 is positioned proximate the top end 14. The magazine 12 may be a magazine for a hand gun or the like and the ammunition 20 may be hand gun ammunition of any conventional design.

A biasing member 32 is provided that has an upper end 34 and a lower end 36. The biasing member 32 is positioned within the magazine 12 and the lower end 36 abuts the bottom end 16 of the magazine 12. The upper end 34 is positioned proximate the top end 14 of the magazine 12 and the biasing member 32 urges the ammunition 20 upwardly toward the top end 14.

A loading unit 38 is positioned within the magazine 12. The loading unit 38 compresses the biasing member 32 to facilitate the ammunition 20 to be loaded into the magazine 12. The loading unit 38 comprises a first block 40 that has a pair of tabs 42 each coupled to and extending downwardly from a body 44 of the first block 40. Each of the tabs 42 is spaced apart from each other such that the first block 40 has a U-shape and the body 44 has a top surface 46 and a bottom surface 48. The first block 40 is slidably positioned within the magazine 12 having each of the tabs 42 slidably engaging an associated one of the front side 26 and the back side 28 of the magazine 12. The top surface 46 abuts the ammunition 20 thereby facilitating the biasing member 32 to urge the ammunition 20 upwardly in the magazine 12.

A second block 50 is provided that has an upper surface 52, a lower surface 54 and a peripheral edge 56 extending therebetween. The peripheral edge 56 is inset between the upper surface 52 and the lower surface 54 to define a first portion 58 and a second portion 60 of the second block 50. The second block 50 has a rod aperture 62 extending through the upper surface 52 and the lower surface 54 and the upper surface 52 corresponding to the first portion 58 abuts the bottom surface 48 of the first block 40. The lower surface 54 corresponding to the first portion 58 abuts the upper end 34 of the biasing member 32 having the second portion 60 extending downwardly between coils 64 of the biasing member 32.

A spring plate 66 is provided that has a topmost surface 68 and a bottommost surface 70. The spring plate 66 has an aperture 72 extending through the topmost surface 68 and the bottommost surface 70. The spring plate 66 is positioned between the lower end 36 of the biasing member 32 and the bottom end 16 of the magazine 12.

A rod 74 has a first end 76 and a second end 78. The rod 74 has a bend 80 therein to define a primary portion 82 forming a right angle with respect to a secondary portion 84 and the bend 80 is positioned closer to the first end 76 than the second end 78. The rod 74 is removably inserted through the aperture 22 in the bottom end 16 of the magazine 12 and the aperture 72 in the spring plate 66. Thus, the first end 76 may threadably engage the rod aperture 62 in the second block 50. The secondary portion 84 is positioned beneath a support surface 86 when the first end 76 threadably engages the second block 50. The support surface 86 may be a table top or the like. A grip 88 is positioned around the rod 74 and the grip 88 extends from the second end 78 to a point located on the primary portion 82. The grip 88 frictionally engages the support surface 86 when the secondary portion 84 is positioned beneath the support surface 86. The grip 88 may be comprised of a resiliently compressible material.

Each of the magazine 12, the first block 40, the spring plate 66 and the biasing member 32 may be conventional components of existing hand gun magazines. The aperture 22 in the bottom end 16 may be manually drilled and the opening 30 in the first lateral side 24 of the magazine 12 may be manually drilled. The opening 30 in the first lateral side 24 has a diameter that is large enough to allow the second end 78 of the rod 74 to be visible when the second end 78 threadably engages the second block 50. Additionally, the aperture 72 in the spring plate 66 may be manually drilled. The rod 74 and the second block 50 may be incorporated into an existing hand gun magazine after the existing hand gun magazine and the existing spring plate are modified. The first block 40 may be commonly referred to as a follower in the existing hand gun magazine.

In use, the rod 74 is inserted through the aperture 22 in bottom end 16 of the magazine 12 and the aperture 72 in the spring plate 66. The rod 74 is directed upwardly through the biasing member 32 until the second end 78 threadably engages the rod aperture 62 in the second block 50. The second end 78 of the rod 74 is aligned with the rod aperture 62 by viewing the rod 74 through the opening 30 in the first lateral side 24 of the magazine 12. The secondary portion 84 of the rod 74 is positioned beneath the support surface 86 and the magazine 12 is urged upwardly from the support surface 86.

The second block 50 compresses the biasing member 32 in the magazine 12 thereby facilitating the ammunition 20 to be loaded into the magazine 12 without encountering resistance generated by the biasing member 32. The rod 74 is removed from the magazine 12 after the ammunition 20 is loaded into the magazine 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An ammunition loading assembly for facilitating loading of ammunition, said assembly comprising a magazine having a top end, said magazine being configured to insertably receive ammunition, said magazine having a bottom end, said bottom end having an aperture extending therethrough;

a biasing member being positioned within said magazine, said biasing member being configured to urge the ammunition upwardly toward said top end;

a loading unit positioned within said magazine, said loading unit compressing said biasing member wherein said loading member is configured to facilitate the ammunition to be loaded into said magazine;

a spring plate having an aperture extending therethrough;

a second block having a rod aperture extending therethrough; and a rod having a first end and a second end, said rod having a bend therein to define a primary portion forming a right angle with respect to a secondary portion, said bend being positioned closer to said first end than said second end, said rod being removably inserted through said aperture in said bottom end of said magazine and said aperture in said spring plate such that said first end threadably engages said rod aperture in said second block.

2. The assembly according to claim 1, wherein said magazine has a top end, a bottom end and a peripheral wall extending between said top end and said bottom end, said top end being open, said magazine being substantially hollow, said top end being configured to insertably receive the ammunition.

3. The assembly according to claim 2, wherein said bottom end has an aperture extending therethrough, said aperture being centrally positioned on said bottom end, said peripheral wall having a first lateral side, a front side and a back side, said first lateral side having an opening extending therethrough, said opening being positioned proximate said top end.

4. The assembly according to claim 2, wherein said biasing member has an upper end and a lower end, said lower end abutting said bottom end of said magazine, said upper end being positioned proximate said top end of said magazine.

5. The assembly according to claim 1, wherein said loading unit comprises a first block having a pair of tabs each coupled to and extending downwardly from a body of said first block, each of said tabs being spaced apart from each other such that said first block has a U-shape, said body having a top surface and a bottom surface.

6. The assembly according to claim 5, wherein:

said magazine has a front side and a back side; and said first block is slidably positioned within said magazine having each of said tabs slidably engaging an associated one of said front side and said back side of said magazine, said top surface being configured to abut the ammunition.

7. The assembly according to claim 1, further comprising a second block having an upper surface, a lower surface and a peripheral edge extending therebetween, said peripheral edge being inset between said upper surface and said lower surface to define a first portion and a second portion of said second block, said second block having a rod aperture extending through said upper surface and said lower surface.

8. The assembly according to claim 7, wherein:

said first block has a bottom surface;

said biasing member has an upper end; and said upper surface corresponding to said first portion abuts said bottom surface of said first block, said lower surface corresponding to said first portion abutting said upper end of said biasing member having said second portion extending downwardly between coils of said biasing member.

9. The assembly according to claim 1, further comprising:

said biasing member has a lower end;

said magazine having a bottom end; and a spring plate having a topmost surface and a bottommost surface, said spring plate having an aperture extending through said topmost surface and said bottommost surface, said spring plate being positioned between said lower end of said biasing member and said bottom end of said magazine.

10. The assembly according to claim 1, wherein said secondary portion is configured to be positioned beneath a support surface when said first end threadably engages said second block, said biasing member being compressed in said magazine thereby spacing said loading unit from said top end of said magazine.

11. The assembly according to claim 10, further comprising a grip positioned around said rod, said grip extending from said second end to a point located on said primary portion, said grip being configured to frictionally engage the support surface when said secondary portion is positioned beneath the support surface.

12. An ammunition loading assembly for facilitating loading of ammunition, said assembly comprising a magazine having a top end, a bottom end and a peripheral wall extending between said top end and said bottom end, said top end being open, said magazine being substantially hollow, said top end being configured to insertably receive ammunition, said bottom end having an aperture extending therethrough, said aperture being centrally positioned on said bottom end, said peripheral wall having a first lateral side, a front side and a back side, said first lateral side having an opening extending therethrough, said opening being positioned proximate said top end;

a biasing member having an upper end and a lower end, said biasing member being positioned within said magazine, said lower end abutting said bottom end of said magazine, said upper end being positioned proximate said top end of said magazine, said biasing member being configured to urge the ammunition upwardly toward said top end, a loading unit positioned within said magazine, said loading unit compressing said biasing member wherein said loading member is configured to facilitate the ammunition to be loaded into said magazine, said loading unit comprising a first block having a pair of tabs each coupled to and extending downwardly from a body of said first block, each of said tabs being spaced apart from each other such that said first block has a U-shape, said body having a top surface and a bottom surface, said first block being slidably positioned within said magazine having each of said tabs slidably engaging an associated one of said front side and said back side of said magazine, said top surface being configured to abut the ammunition, a second block having an upper surface, a lower surface and a peripheral edge extending therebetween, said peripheral edge being inset between said upper surface and said lower surface to define a first portion and a second portion of said second block, said second block having a rod aperture extending through said upper surface and said lower surface, said upper surface corresponding to said first portion abutting said bottom surface of said first block, said lower surface corresponding to said first portion abutting said upper end of said biasing member having said second portion extending downwardly between coils of said biasing member, a spring plate having a topmost surface and a bottommost surface, said spring plate having an aperture extending through said topmost surface and said bottommost surface, said spring plate being positioned between said lower end of said biasing member and said bottom end of said magazine, a rod having a first end and a second end, said rod having a bend therein to define a primary portion forming a right angle with respect to a secondary portion, said bend being positioned closer to said first end than said second end, said rod being removably inserted through said aperture in said bottom end of said magazine and said aperture in said spring plate such that said first end threadably engages said rod aperture in said second block, said secondary portion being configured to be positioned beneath a support surface when said first end threadably engages said second block, said biasing member being compressed in said magazine thereby spacing said loading unit from said top end of said magazine, and a grip positioned around said rod, said grip extending from said second end to a point located on said primary portion, said grip being configured to frictionally engage the support surface when said secondary portion is positioned beneath the support surface.

* * * * *